United States Patent [19]

Levy et al.

[11] Patent Number: 4,936,479

[45] Date of Patent: Jun. 26, 1990

[54] HAMBURGER HOLDER

[76] Inventors: Dan Levy, P.O. Box 6-448, El Dorado, Panama; George Spector, 233 Broadway RM 3815, New York, N.Y. 10007

[21] Appl. No.: 339,513

[22] Filed: Apr. 17, 1989

[51] Int. Cl.[5] ..... B65D 6/02

[52] U.S. Cl. ..... 220/4 B; 206/525; 220/8; 229/DIG. 13; 426/115; 426/132

[58] Field of Search ..... 220/4 B, 4 E, 8; 229/87 F, DIG. 13; 426/115, 128, 132; 206/525

[56] References Cited

U.S. PATENT DOCUMENTS

| | | | |
|---|---|---|---|
| 2,145,481 | 1/1939 | Harvey | 229/DIG. 13 |
| 2,625,292 | 1/1953 | Spender | 220/4 B |
| 2,800,945 | 7/1957 | Schilling | 220/4 E |
| 3,032,228 | 5/1962 | Andrews | 220/4 E |
| 3,283,889 | 11/1966 | Hetrick et al. | 426/115 X |
| 3,391,782 | 7/1968 | Kaspar | 206/525 X |
| 3,511,433 | 5/1970 | Andrews et al. | 220/4 E |
| 3,933,295 | 1/1976 | Congleton | 229/2.5 R |
| 4,189,054 | 2/1980 | Liv et al. | 229/87 F X |
| 4,273,249 | 6/1981 | Florian | 220/4 E |

*Primary Examiner*—Bryon P. Gehman

[57] ABSTRACT

A hamburger holder is provided and consists of a pair of hollow semi-cylindrical disc-shaped receptacles. The hamburger is stored within the receptacles until one is removed allowing a person to hold the remaining receptacle and eat the hamburger.

4 Claims, 1 Drawing Sheet

HAMBURGER HOLDER

BACKGROUND OF THE INVENTION

The instant invention relates generally to food packaging and more specifically it relates to a hamburger holder.

Numerous food packages have been provided in prior art that are adapted to protect various foods. For example, U.S. Pat. Nos. 2,947,637; 3,575,337 and 3,610,512 all are illustrative of such prior art. While these units may be suitable for the particular purpose to which they address, they would not be as suitable for the purposes of the present invention as heretofore described.

SUMMARY OF THE INVENTION

A primary object of the present invention is to provide a hamburger holder that will overcome the shortcomings of the prior art devices.

Another object is to provide a hamburger holder that prevents various food articles in the hamburger from falling out while a person eats the hamburger.

An additional object is to provide a hamburger holder that keeps the hands and fingers clean while it prevents the hamburger from becoming contaminated from dirty hands and fingers.

A further object is to provide a hamburger holder that is simple and easy to use.

A still further object is to provide a hamburger holder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
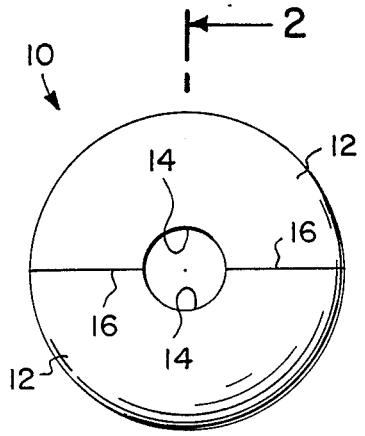
FIG. 1 is an elevational view of the invention.
Figure 2:
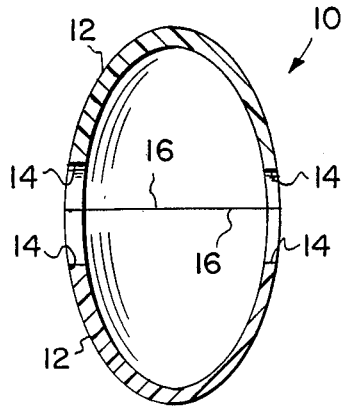
FIG. 2 is an enlarged cross sectional view taken along line 2—2 in FIG. 1.
Figure 3:
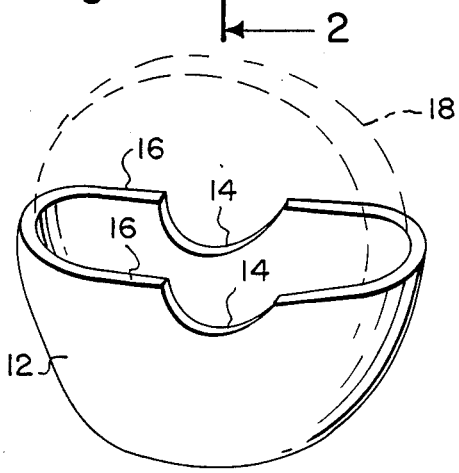
FIG. 3 is a perspective view with the upper portion removed so that the hamburger can be eaten.

Turning now descriptively to the drawings, in which similar reference characters denote similar elements throughout the several views, FIGS. 1 and 2 illustrate a hamburger holder 10 consisting of a pair of hollow semi cylindrical disc shaped receptacles 12. Each of the receptacles 12 has two semi circular cutouts 14. Each of the cutouts 14 is located at center of one flat edge 16 thereof. When a hamburger 18 is stored within the receptacle 12, one of the receptacles 12 can be removed, as shown in FIG. 3, allowing a person (not shown) to hold the remaining receptacle 12 and turn the hamburger 18 through the cutouts 14 while eating the hamburger.

The receptacles 12 can be fabricated out of disposable plastic material or from strong durable metal material.

Figure 4:
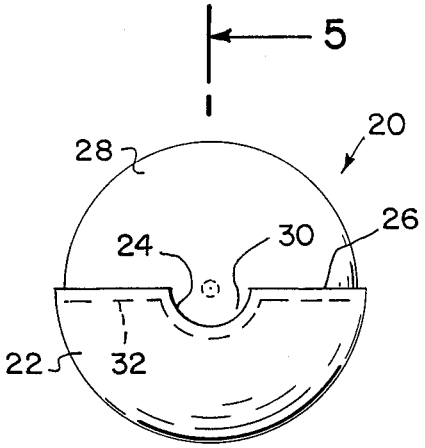
FIG. 4 is an elevational view similar to FIG. 1 of a modification in which the upper portion fits into the lower portion and includes pins to engage with the hamburger.
Figure 5:
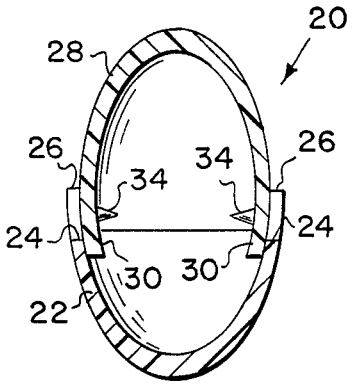
FIG. 5 is an enlarged cross sectional view taken along line 5—5 in FIG. 4.

FIGS. 4 and 5 show a modified hamburger holder 20 consisting of a first hollow semi cylindrical disc shaped receptacle 22 having two semi circular cutouts 24, each located at center of each flat edge 26 thereof. A second hollow semi cylindrical disc shaped receptacle 28 has two semi circular portions 30, each located at and extending from center of each flat edge 32 thereof. A pair of inwardly facing pins 34 are also provided. Each pin 34 is formed on one of the semi circular portions 30 so that when a hamburger 18 is stored within the receptacles 22 and 28, the first receptacle 28 is removed allowing a person (not shown) to hold the second receptacle 28 and turn the hamburger 18 about the pins 34 while eating the hamburger 18.

Figure 6:
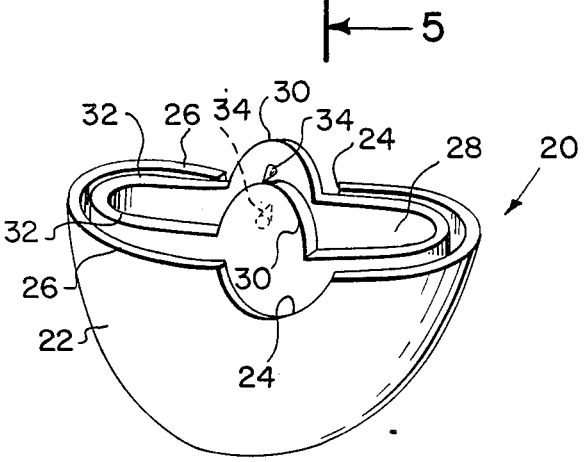
FIG. 6 is a perspective view of the modification in a stored non-use position.

As shown in FIG. 6, the second receptacle 28 is sized to fit into the first receptacle in a stored nonuse position whereby a person can remove the second receptacle 28 from the first receptacle 22 by gripping the semi circular portions 30.

The receptacles 22 and 28 can also be fabricated out of disposable plastic material or from strong durable metal material.

The invention can be applied to other types of round sandwiches, such as fish, chicken, cheese, ham, etc., so as to prevent foods from falling out therefrom.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A hamburger holder which comprises:

(a) a first hollow semi-cylindrical disc shaped receptacle with a flat edge along a diameter having two semi-circular cutouts, centrally located at said flat edge;

(b) a second hollow semi-cylindrical disc shaped receptacle having a flat edge with two semi-circular aligned portions, each located at and extending from the center of said flat edge thereof; and (c) a pair of inwardly facing pins, each formed on one of said semi-circular portions so that when a hamburger is stored within said receptacles, said first receptacle is removed allowing a person to hold said second receptacle and turn the hamburger about said pins while eating the hamburger.

2. A hamburger holder as recited in claim 1, wherein said second receptacle is sized to fit into said first receptacle in a stored non-use position whereby a person can remove said second receptacle from said first receptacle by gripping said semi-circular portions.

3. A hamburger holder as recited in claim 2, wherein said receptacles are fabricated out of disposal plastic material.

4. A hamburger holder as recited in claim 2, wherein said receptacles are fabricated out of strong durable metal material.

* * * * *